US010309650B2

(12) United States Patent
Kobayashi

(10) Patent No.: US 10,309,650 B2
(45) Date of Patent: Jun. 4, 2019

(54) CERAMIC HEATER

(71) Applicant: KYOCERA Corporation, Kyoto-shi, Kyoto (JP)

(72) Inventor: Akio Kobayashi, Kyoto (JP)

(73) Assignee: KYOCERA CORPORATION, Kyoto (JP)

( * ) Notice: Subject to any disclaimer, the term of this patent is extended or adjusted under 35 U.S.C. 154(b) by 648 days.

(21) Appl. No.: 14/787,340

(22) PCT Filed: Apr. 25, 2014

(86) PCT No.: PCT/JP2014/061695

§ 371 (c)(1),
(2) Date: Oct. 27, 2015

(87) PCT Pub. No.: WO2014/175424

PCT Pub. Date: Oct. 30, 2014

(65) Prior Publication Data

US 2016/0061447 A1 Mar. 3, 2016

(30) Foreign Application Priority Data

Apr. 27, 2013 (JP) ..... 2013-094803

(51) Int. Cl.
*H05B 3/12* (2006.01)
*H05B 3/18* (2006.01)
(Continued)

(52) U.S. Cl.
CPC ..... *F23Q 7/001* (2013.01); *F23Q 7/22* (2013.01); *H05B 3/12* (2013.01); *H05B 3/18* (2013.01);
(Continued)

(58) Field of Classification Search
CPC ... H05B 3/08; H05B 3/18; H05B 3/28; H05B 3/283; H05B 3/141; H05B 3/148;
(Continued)

(56) References Cited

U.S. PATENT DOCUMENTS 4,634,837 A * 1/1987 Ito ..... C04B 35/58092 123/145 A
6,274,855 B1 * 8/2001 Tatematsu ..... H05B 3/141 219/505

(Continued)

FOREIGN PATENT DOCUMENTS

JP 2000-156275 A 6/2000

OTHER PUBLICATIONS

International Search Report, PCT/JP2014/061695, dated Jun. 10, 2014, 2 pgs.

*Primary Examiner* — Brian W Jennison
(74) *Attorney, Agent, or Firm* — Volpe and Koenig, P.C.

(57) ABSTRACT

A ceramic heater of the invention includes a ceramic structure; a heat-generating resistor embedded in the ceramic structure; and a feeder line embedded in the ceramic structure so as to be connected, at one end thereof, to the heat-generating resistor. The feeder line is made of metal, and metal grains of a center region of the feeder line are greater in grain size than metal grains of an outer periphery region of the feeder line. Even if a crack developed in the outer periphery region of the feeder line propagates through grain boundaries in the outer periphery region and comes near the center region, propagation of the crack through the interior of the center region can be suppressed.

8 Claims, 3 Drawing Sheets

(51) Int. Cl.

| | |
|---|---|
| ***F23Q 7/00*** | (2006.01) |
| ***H05B 3/48*** | (2006.01) |
| ***F23Q 7/22*** | (2006.01) |
| ***H05B 3/28*** | (2006.01) |

(52) U.S. Cl.
CPC ..... *H05B 3/283* (2013.01); *H05B 3/48* (2013.01); *H05B 2203/027* (2013.01)

(58) Field of Classification Search
CPC ..... H05B 2203/027; H05B 2203/018; F23Q 7/00; F23Q 7/22; F23Q 7/23; F23Q 7/001
USPC ..... 219/270, 548, 553, 505
See application file for complete search history.

(56) References Cited

U.S. PATENT DOCUMENTS

| | | | | |
|---|---|---|---|---|
| 2006/0086703 | A1* | 4/2006 | Liu ..... | B23K 26/38 219/121.72 |
| 2012/0145695 | A1* | 6/2012 | Radmacher ..... | B28B 1/008 219/270 |

* cited by examiner

CERAMIC HEATER

TECHNICAL FIELD

The present invention relates to a ceramic heater.

BACKGROUND ART

Ceramic heaters are known as heaters for use in, for example, a vehicle-mounted heating system, an oil fan heater, or a glow plug of an automotive engine. For example, in Japanese Unexamined Patent Publication JP-A 2000-156275 (hereafter referred to as "Patent Literature 1"), there is disclosed an example of the ceramic heaters.

The ceramic heater disclosed in Patent Literature 1 comprises: a ceramic structure; a heat-generating resistor embedded in the ceramic structure; and a feeder line embedded in the ceramic structure so as to be connected to the heat-generating resistor.

However, in the ceramic heater disclosed in Patent Literature 1, the possibility arises that due to repeated use in a high-temperature environment the feeder line will be subject to cracking or the like. This causes changes in the resistance value of the feeder line, which may lead to localized unusual heat generation. As a consequence, it is difficult to achieve an improvement in long-term reliability for the case of using the ceramic heater repeatedly in a high-temperature environment.

SUMMARY OF INVENTION

A ceramic heater in accordance with an embodiment of the invention comprises a ceramic structure, a heat-generating resistor embedded in the ceramic structure, and a feeder line embedded in the ceramic structure so as to be connected, at one end thereof, to the heat-generating resistor, the feeder line being made of metal, and metal grains of a center region of the feeder line being greater in grain size than metal grains of an outer periphery region of the feeder line.

DESCRIPTION OF EMBODIMENTS

Hereinafter, several exemplificative embodiments of the invention will be described with reference to drawings.

<Ceramic Heater Construction>

Figure 1:
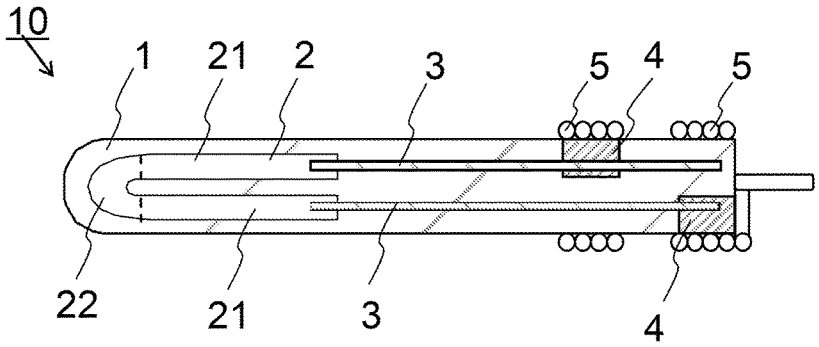
FIG. 1 is a sectional view showing a ceramic heater in accordance with an embodiment of the invention.

As shown in FIG. 1, a ceramic heater 10 in accordance with an embodiment of the invention comprises: a ceramic structure 1; a heat-generating resistor 2 embedded in the ceramic structure 1; and a feeder line 3 embedded in the ceramic structure 1 so as to be connected, at one end thereof, to the heat-generating resistor 2. The ceramic heater 10 can be used for a glow plug of an automotive engine, for example.

<Ceramic Structure Construction>

The ceramic structure 1 is a member having interiorly embedded heat-generating resistor 2 and feeder line 3. The placement of the heat-generating resistor 2 and the feeder line 3 within the ceramic structure 1 helps improve the resistance to environment of the heat-generating resistor 2 and the feeder line 3. For example, the ceramic structure 1 is a rod-like or platy member.

The ceramic structure 1 is made of electrically insulating ceramics such for example as oxide ceramics, nitride ceramics, or carbide ceramics. More specifically, the ceramic structure 1 is made of alumina ceramics, silicon nitride ceramics, aluminum nitride ceramics, or silicon carbide ceramics, for example.

It is preferable that the ceramic structure 1 is made of, in particular, silicon nitride ceramics. This is because silicon nitride ceramics is predominantly composed of silicon nitride which excels in strength, toughness, insulation capability, and resistance to heat. The ceramic structure 1 made of silicon nitride ceramics can be obtained in the following manner. That is, for example, silicon nitride, which is a major constituent, is mixed with sintering aids, namely a rare-earth element oxide such as $Y_2O_2$, $Yb_2O_3$, or $Er_2O_3$ in an amount of 5 to 15% by mass, $Al_2O_3$ in an amount of 0.5 to 5% by mass, and $SiO_2$ in an amount adjusted so that the amount of $SiO_2$ contained in a resultant sintered product will be 1.5 to 5% by mass, and, the mixture is molded into a predetermined shape and then fired at a temperature in a range of 1650 to 1780° C. Thus, the ceramic structure 1 made of silicon nitride ceramics is produced. For example, hot-pressing firing may be adopted in the firing process.

In a case where silicon nitride ceramics is used for the ceramic structure 1, and a compound of metal such for example as Mo or W is used for the heat-generating resistor 2 which will hereafter be described, it is preferable that, for example, $MoSi_2$ or $WSi_2$ is additionally mixed, in a dispersed state, in the ceramic structure 1. With the dispersion of a silicide based on the metal used for the heat-generating resistor 2 in the ceramic structure 1, the coefficient of thermal expansion of the ceramic structure 1 and the coefficient of thermal expansion of the heat-generating resistor 2 can be approximated to each other. This helps enhance the durability of the ceramic heater 10.

In a case where the ceramic structure 1 has a rod-like shape, or more specifically a cylindrical shape, the ceramic structure 1 is designed to have a length in a range of 20 to 50 mm, and have a diameter in a range of 3 to 5 mm, for example.

<Heat-Generating Resistor Construction>

The heat-generating resistor 2 is a member which produces heat by voltage application. The heat-generating resistor 2 is embedded in the ceramic structure 1. Application of a voltage to the heat-generating resistor 2 produces the flow of electric current, thus causing the heat-generating resistor 2 to produce heat. As the thereby produced heat is transmitted through the interior of the ceramic structure 1, the surface of the ceramic structure 1 is subjected to a high temperature. The heat is then transferred to an object to be heated from the surface of the ceramic structure 1. Thus, the ceramic heater 10 serves as a heater. Examples of the to-be-heated object to which is transferred heat from the surface of the ceramic structure 1 include light oil which is fed into an automotive diesel engine.

The heat-generating resistor 2 is disposed on the front-end side of the ceramic structure 1. When viewed in longitudinal section of the heat-generating resistor 2 (the section parallel to the lengthwise direction of the heat-generating resistor 2), for example, the heat-generating resistor 2 is configured to be turned back. More specifically, the heat-generating resistor 2 is composed of two parallel linear portions 21 and a connection portion 22 which has substantially semi-circular or semi-elliptical outer and inner periphery and provides connection between the two linear portions 21 in turned-back configuration. The heat-generating resistor 2 is turned back in the vicinity of the front end of the ceramic structure 1. The distance from the front end of the heat-generating resistor 2 (the extremity of the connection portion 22) to the rear end of the heat-generating resistor 2 (the rear end of the linear portion 21) is adjusted to be a length of 2 to 10 mm in the lengthwise direction of the heat-generating resistor 2, for example. When viewed in transverse section of the heat-generating resistor 2 (the section perpendicular to the lengthwise direction of the heat-generating resistor 2), the heat-generating resistor 2 has a circular profile, an elliptical profile, or a rectangular profile, for example.

For example, the heat-generating resistor 2 is predominantly composed of a carbide, a nitride, or a silicide based on W, Mo, or Ti. In a case where the ceramic structure 1 is made of silicon nitride ceramics, it is preferable that the major constituent of the heat-generating resistor 2 is tungsten carbide. In this case, the coefficient of thermal expansion of the ceramic structure 1 and the coefficient of thermal expansion of the heat-generating resistor 2 can be approximated to each other. Moreover, tungsten carbide excels in resistance to heat.

Moreover, where the ceramic structure 1 is made of silicon nitride ceramics, it is preferable that the heat-generating resistor 2 is predominantly composed of tungsten carbide, and also, in the heat-generating resistor 2, silicon nitride is added in an amount of greater than or equal to 20% by mass. The addition of silicon nitride to the heat-generating resistor 2 makes it possible to approximate the coefficient of thermal expansion of the heat-generating resistor 2 to the coefficient of thermal expansion of the ceramic structure 1, and thereby reduce a thermal stress which is developed between the heat-generating resistor 2 and the ceramic structure 1 during the rise or lowering of the temperature of the ceramic heater 10.

<Feeder Line Construction>

The feeder line 3 is a member for connecting an external power supply to the heat-generating resistor 2. The feeder line 3 is embedded in the ceramic structure 1. Two feeder lines 3 are arranged in correspondence with the two linear portions 21, respectively, of the heat-generating resistor 2 in the lengthwise direction of the ceramic structure 1. The feeder lines 3 are electrically connected to their respective ends of the heat-generating resistor 2. That is, the feeder lines 3 make contact with their respective ends of the heat-generating resistor 2. The feeder line 3 is disposed so as to extend from the end of the heat-generating resistor 2 toward the rear end of the ceramic structure 1.

For example, the feeder line 3 is formed of a metallic lead wire. A lead wire of metal such for example as tungsten (W), molybdenum (Mo), rhenium (Re), tantalum (Ta), or niobium (Nb) may be used for the feeder line 3. The feeder line 3 is designed to be lower in resistance per unit length than the heat-generating resistor 2.

Figure 2:
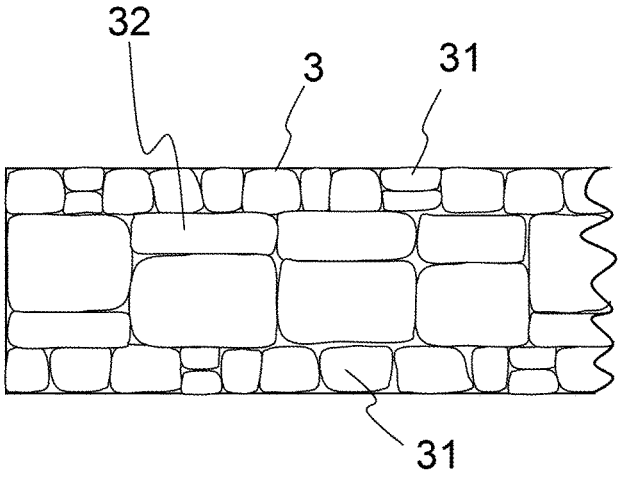
FIG. 2 is an enlarged fragmentary sectional view of the ceramic heater shown in FIG. 1.

As shown in FIG. 2, metal grains of a center region 32 of the feeder line 3 are greater in grain size than metal grains of an outer periphery region 31 of the feeder line 3. In the feeder line 3 in which the metal grains of the center region 32 is greater in grain size than the metal grains of the outer periphery region 31, contact portions between a grain boundary between the metal grains of the outer periphery region 31 and a grain boundary between the metal grains of the center region 32 can be reduced. Thus, for example, even if a crack developed in the outer periphery region 31 propagates through grain boundaries in the outer periphery region 31 and comes near the center region 32, propagation of the crack through the interior of the center region 32 can be suppressed. This makes it possible to suppress changes in the resistance value of the feeder line 3 during repeated operation in a high-temperature environment. As a consequence, the possibility of occurrence of unusual heat generation in the feeder line 3 can be decreased, thus achieving an improvement in long-term reliability for the case of using the ceramic heater 10 repeatedly in a high-temperature environment.

Moreover, the smallness of the grain size of the metal grains of the outer periphery region 31 is conducive to an increase of grain boundaries among metal grains, thus easily causing the feeder line 3 to undergo minute deformation at the outer periphery region 31. Therefore, even if a thermal stress is developed under heat cycles due to the difference in thermal expansion between the ceramic structure 1 and the feeder line 3, since the outer periphery region 31 of the feeder line 3 becomes deformed easily, the thermal stress can be absorbed by virtue of the deformation of the outer periphery region 31. This helps decrease the possibility of occurrence of cracking in the feeder line 3.

For example, metal grain size comparison can be made in the following manner. After taking a photograph of the longitudinal section of the feeder line 3 (the section parallel to the lengthwise direction of the feeder line 3), in the longitudinal section, an imaginary straight line parallel to the lengthwise direction of the feeder line 3 is drawn in each of the center region 32 and the outer periphery region 31. When the number of grains lying on the imaginary straight line drawn in the outer periphery region 31 is greater than the number of grains lying on the imaginary straight line drawn in the center region 32, the metal grains of the outer periphery region 31 can be considered to be smaller in grain size than the metal grains of the center region 32. The length of the imaginary straight line is determined properly in accordance with metal grain size, and more specifically, for example, the length is set at 300 μm.

The following method may be adopted to adjust the grain size of the metal grains of the center region 32 to be greater than that of the metal grains of the outer periphery region 31. That is, for example, where a lead wire made of W is used as the feeder line 3, the lead wire is designed to contain potassium (K) in an amount of less than 10 ppm in a yet-to-be-fired state, and, a binder used for the ceramic structure 1 is designed to contain K in an amount of greater than or equal to 50 ppm. More specifically, with the inclusion of potassium oxide (K2O), the amount of K is adjusted to fall in the range of 50 ppm or above to 1000 ppm or below. Then, the ceramic structure 1 and the feeder line 3 are integrally fired by the hot-pressing technique. In this way, K is diffused from the ceramic structure 1 to the outer periphery region 31 of the feeder line 3 during the firing process. When the feeder line 3 made of W is fired while undergoing diffusion of K, in the W-made outer periphery, the growth of recrystallized grains is suppressed due to K diffusion, wherefore secondary recrystallization is less likely to occur, with the consequence that metal grains in the fired outer periphery have a small grain size. That is, metal grains of the outer periphery region 31 of the feeder line 3 containing a larger amount of K have a smaller grain size, whereas metal grains of the center region 32 of the feeder line 3 containing a little amount of K have a larger grain size due to the growth of recrystallized grains. Thus, there is obtained the feeder line 3 of the ceramic heater 10 of the present embodiment.

Moreover, it is preferable that, in the feeder line 3, the center region 32 is greater in elastic modulus than the outer periphery region 31. A method similar to the aforestated method may be adopted to adjust the elastic modulus of the center region 32 to be greater than that of the outer periphery region 31. That is, the W-made feeder line 3 is so designed that the outer periphery region 31 contains a larger amount of K than does other region. The region containing a larger amount of K is smaller in grain size than the region containing a little amount of K. The smallness of grain size is conducive to an increase of the points of contact between grains in the metallic structure, thus easily causing deformation in metal grain boundaries, wherefore the elastic modulus of the outer periphery region 31 is smaller than that of the center region 32. The center region 32 having a greater elastic modulus is restrained against deformation. This makes it possible to reduce the degree of expansion and contraction of the feeder line 3, and thereby suppress propagation of a crack.

Moreover, it is preferable that grain boundaries between the metal grains of the center region 32 include a plurality of planes oriented differently from each other with respect to a circumferential direction of the feeder line. Since grain boundaries are oriented differently from each other with respect to the circumferential direction and are not oriented in the same direction, a crack is restrained from propagating in the lengthwise direction of the feeder line 3.

It is also preferable that grain boundaries between the metal grains of the center region 32 and the metal grains of the outer periphery region 31 include a plurality of planes oriented differently from each other with respect to the lengthwise direction of the feeder line 3. In the case where the grain boundaries between the outer periphery region 31 and the center region 32 have irregularities, a crack is restrained from propagating in the lengthwise direction of the feeder line 3.

Moreover, it is preferable that a plurality of voids are present in the interior of the feeder line 3. In the presence of voids within the feeder line 3, heat generated from the heat-generating resistor 2 is restrained against escape through the feeder line 3. The following method may be adopted to create voids within the feeder line 3. For example, in a case where the feeder line 3 is made of tungsten, a minute amount of a dope is added, while being dispersed, to molten tungsten. After that, the tungsten is cooled down and hardened, and is then worked into a feeder line 3 containing internal voids. As the dope, alumina ($Al_2O_3$), silica ($SiO_2$) or the like can be used.

It is preferable that the voids within the feeder line 3 are especially present at grain boundaries between the metal grains of the center region 32 of the feeder line 3. The presence of the voids at the grain boundaries which are susceptible to crack propagation helps block propagation of a crack in the feeder line 3.

<Electrode Extraction Portion Construction>

Returning to FIG. 1, the ceramic heater 10 further comprises two electrode extraction portions 4. The electrode extraction portion 4 is a member for electrically connecting an external electrode to each of the two feeder lines 3. The electrode extraction portion 4 is disposed in the ceramic structure 1. One of the electrode extraction portions 4 is connected to one of the feeder lines 3, and the other one of the electrode extraction portions 4 is connected to the other one of the feeder lines 3. The electrode extraction portion 4 has its one end kept in contact with the feeder line 3 in the interior of the ceramic structure 1, and has its other end left exposed at the surface of the ceramic structure 1.

The electrode extraction portion 4 may be made of a material similar to the material used for the heat-generating resistor 2. The electrode extraction portion 4 is designed to be lower in resistance per unit length than the heat-generating resistor 2.

<Connector Fitting Construction>

The ceramic heater 10 further comprises a connector fitting 5. The connector fitting 5 is connected to a part of the electrode extraction portion 4 which is left exposed at the surface of the ceramic structure 1. The ceramic heater 10 is connected to an external electrode via the connector fitting 5. In the ceramic heater 10 of the present embodiment, a coil fitting is used as the connector fitting 5. The connector fitting 5 is disposed so as to surround the ceramic structure 1.

<As to Glow Plug>

Figure 3:
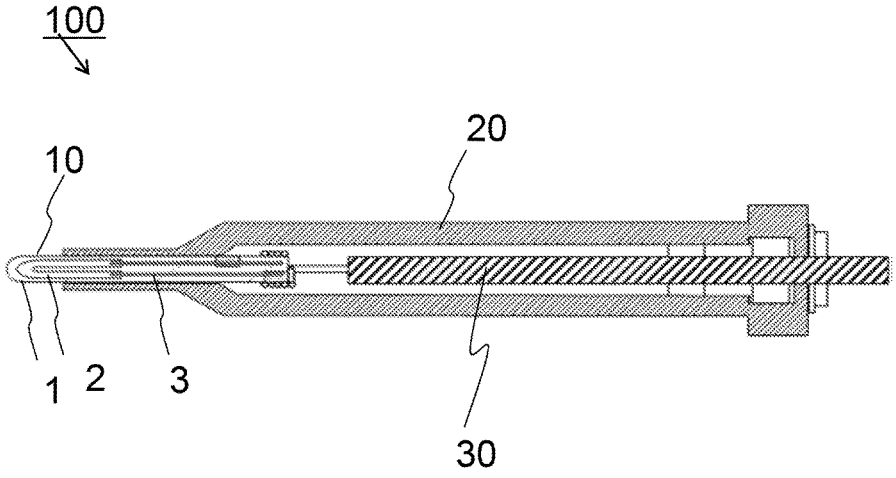
FIG. 3 is a sectional view showing a glow plug incorporating the ceramic heater shown in FIG. 1.

The ceramic heater 10 is used for a glow plug, for example. More specifically, as shown in FIG. 3, a glow plug 100 comprises the ceramic heater 10 and a metal-made retainer 20 (sheath fitting) for holding the ceramic heater 10. The rear-end side of the ceramic heater 10 is inserted in the tubular metal-made retainer 20 while being connected to an external power source via a power supply terminal 30. The ceramic heater 10 of the present embodiment is capable of suppressing crack propagation in the interior of the center region 32 of the feeder line 3, and thus achieving an improvement in long-term reliability when incorporated in the glow plug 100.

<As to Ceramic-Heater Manufacturing Method>

A method of manufacturing the ceramic heater 10 will be described. At first, a ceramic powdery body, which is a raw material used for the ceramic structure 1, is prepared by containing a sintering aid in powder of ceramics such as alumina ceramics, silicon nitride ceramics, aluminum nitride ceramics, or silicon carbide ceramics.

Then, the ceramic powdery body is formed into a ceramic slurry, and the ceramic slurry is molded in sheet form to prepare two ceramic green sheets. In preparing the ceramic green sheets, it is preferable that a binder in use contains $K_2O$ in an amount of greater than or equal to 50 ppm. This makes it possible to diffuse K from the ceramic structure 1 to the feeder line 3 during a firing process.

Next, a first molded body is obtained by printing the patterns of, respectively, a heat-generating resistor 2-forming conductive paste which constitutes the heat-generating resistor 2 and an electrode extraction portion 4-forming conductive paste onto one of the ceramic green sheets. Materials composed predominantly of high-melting-point metal such as V, Nb, Ta, Mo, or W are used as the constituent material of the heat-generating resistor 2-forming conductive paste and the electrode extraction portion 4-forming conductive paste. The heat-generating resistor 2-forming conductive paste and the electrode extraction portion 4-forming conductive paste can be prepared by blending a ceramic powdery body, a binder, an organic solvent, and so forth into such a high-melting-point metal.

In preparing the heat-generating resistor 2-forming conductive paste, the addition of a ceramic powdery body made of the same material as that used for the ceramic structure 1 makes it possible to approximate the coefficient of thermal expansion of the heat-generating resistor 2 to the coefficient of thermal expansion of the ceramic structure 1.

Moreover, on the other one of the ceramic green sheets, there is formed a second molded body in which the feeder line 3 is embedded so as to lie between the heat-generating resistor 2 and the electrode extraction portion 4. A lead wire of high-purity metal such for example as W, Mo, Re, Ta, or Nb is used for the feeder line 3. In particular, a metallic lead wire containing K in an amount of less than or equal to 10 ppm is used.

The thereby obtained first and second molded bodies are stacked together to obtain a third molded body interiorly formed with the patterns of the heat-generating resistor 2-forming conductive paste, the feeder line 3, and the electrode extraction portion 4-forming conductive paste.

Then, the thereby obtained third molded body is fired at 1500 to 1800° C., whereby the ceramic heater 10 can be manufactured. At this time, the diffusion of K from the ceramic structure 1 to the feeder line 3 enables metal grains in the outer periphery region 31 of the feeder line 3 to have a small grain size. This makes it possible to obtain the ceramic heater 10 having the feeder line 3 in which the grain size of the metal grains of the center region 32 is greater than the grain size of the metal grains of the outer periphery region 31. It is preferable that the firing process is performed in an atmosphere of an inert gas or in a reduction atmosphere. It is also preferable that the firing process is performed with application of pressure.

Examples

A ceramic heater was produced by way of an example of the invention in the following manner.

To begin with, raw material powder was prepared by mixing silicon nitride powder, which is a raw material for constituting the ceramic structure 1, in an amount of 85% by mass with sintering aids, namely $Yb_2O_3$ powder in an amount of 10% by mass, $MoSi_2$ powder in an amount of 3.5% by mass, and aluminum oxide powder in an amount of 1.5% by mass. After that, the first molded body and the second molded body that constitute the ceramic structure 1 were prepared using the raw material powder by means of pressure molding. At this time, 100 ppm $K_2O$ content was imparted to the binder used for the silicon nitride powder.

Next, an electrically conductive paste for constituting the heat-generating resistor 2 and the electrode extraction portion 4 was prepared by mixing tungsten carbide (WC) powder in an amount of 70% by mass with the raw material powder in an amount of 30% by mass, and then adding suitable organic solvent and solution medium to the mixture. Then, the conductive paste was applied to the surface of the first molded body which constitutes the ceramic structure 1 by means of screen printing.

The feeder line 3 was embedded so as to be located between the heat-generating resistor 2 and the electrode extraction portion 4 when the first molded body and the second molded body are stacked together in intimate contact. As the feeder line 3, a W lead pin made of tungsten of 99.9% purity having K content of less than or equal to 5 ppm was used. Then, the first and second molded bodies were stacked together to obtain the third molded body comprising the ceramic structure 1 provided interiorly with the heat-generating resistor 2, the feeder line 3, and the electrode extraction portion 4.

Next, the third molded body was placed in a cylindrical carbon-made mold, and hot-pressing firing thereof was then carried out in a reduction atmosphere and under a temperature of 1700° C. and a pressure of 35 MPa, whereby the ceramic heater 10 (Sample 1) was produced.

On the other hand, another ceramic heater (Sample 2) was produced for comparative evaluation purposes. In Sample 2, as the feeder line 3, a W lead pin made of tungsten of 99.0% purity having K content of 20 ppm was used.

Next, the thereby obtained ceramic heater was ground into a cylindrical form which is 4 mm in diameter (φ) and 40 mm in overall length, and, a Ni-made coil-like connector fitting 5 was brazed to the electrode extraction portion 4 left exposed at the surface.

Then, a voltage was applied to each prepared heater sample until its temperature was raised to 1500° C. for intermittent current application. More specifically, current application is continued for 1 minute at a temperature of 1500° C.±25° C., and, after a 1-minute interruption of current application, air cooling is effected. Given this series of steps of 1 cycle, 10000 cycles of current-application operation were conducted. Then, measurements of an initial resistance value and a resistance value as observed after the completion of 10000 cycles were performed to compare the resistance variation rates of Samples 1 and 2. The following method was adopted for resistance measurements. Specifically, after the tip of the heater was immersed in a constant-temperature bath set at 25° C. to stably maintain the temperature of the ceramic heater at 25° C., resistance measurements were conducted.

Moreover, following the completion of 10000 cycles of operation, a part corresponding to the feeder line 3 was cut, and, after polishing the cut section to a mirror-smooth state, the mirror-finished surface was subjected to an ion trimming process. Then, its longitudinal section was examined by observation using SEM at 2000-fold magnification.

The observation result showed that the heater of Sample 2 implemented as a comparative example exhibited a resistance variation rate of 25% after the completion of 10000 cycles of operation, and also the result of SEM observation of the feeder-line 3 part showed that, in the feeder line 3, the grain size of the metal grains of the outer periphery region 31 is greater than the grain size of the metal grains of the center region 32. Furthermore, it has been found that a crack was developed in the outer periphery region 31 and propagated through the center region 32 in the feeder line 3.

In contrast, the ceramic heater 10 of Sample 1 implemented as an example of the invention showed no sign of resistance variation even after the completion of 10000 cycles of operation. Moreover, the result of SEM observation showed that the grain size of the metal grains of the center region 32 is greater than the grain size of the metal grains of the outer periphery region 31, and that no crack propagated through the center region 32 of the feeder line 3. Note that the feeder line 3 has an outside diameter of 0.3 mm (φ), and, an area extending internally from the outer circumference by a length of 0.02 mm defines the outer periphery region 31, and the rest area defines the center region 32. Note also that the metal grains of the outer periphery region 31 have a grain size of about 5 to 20 μm, whereas the metal grains of the center region 32 have a grain size of about 40 to 80 μm.

REFERENCE SIGNS LIST

1: Ceramic structure
2: Heat-generating resistor
21: Linear portion
22: Connection portion
3: Feeder line
31: Outer periphery region
32: Center region
4: Electrode extraction portion
5: Connector fitting
6: Conductor layer
10: Ceramic heater
20: Metal-made retainer
30: Power supply terminal
100: Glow plug

The invention claimed is:

1. A ceramic heater, comprising:

a ceramic structure;

a heat-generating resistor embedded in the ceramic structure; and a feeder line embedded in the ceramic structure so as to be connected, at one end thereof, to the heat-generating resistor, the feeder line being made of metal, and the feeder line includes at least a center region and an outer periphery region, wherein the center region and the outer periphery region are co-axial, and a grain size of metal grains in the center region of the feeder line is greater than a grain size of metal grains in the outer periphery region of the feeder line.

2. The ceramic heater according to claim 1, wherein the center region of the feeder line is greater in elastic modulus than the outer periphery region of the feeder line.

3. The ceramic heater according to claim 1, wherein grain boundaries between the metal grains of the center region of the feeder line include a plurality of planes oriented differently from each other with respect to a circumferential direction of the feeder line.

4. The ceramic heater according to claim 1, wherein grain boundaries between the metal grains of the center region of the feeder line and the metal grains of the outer periphery region of the feeder line include a plurality of planes oriented differently from each other with respect to a lengthwise direction of the feeder line.

5. The ceramic heater according to claim 1, wherein a plurality of voids are present in an interior of the feeder line.

6. The ceramic heater according to claim 5, wherein, the plurality of voids are present at grain boundaries between the metal grains of the center region of the feeder line.

7. A glow plug, comprising:

a ceramic heater according to claim 1; and a metal-made retainer which holds the ceramic heater.

8. The ceramic heater according to claim 1, wherein the center region of the feeder line is in physical contact with the outer periphery region of the feeder line.

* * * * *